US006769355B1

(12) United States Patent
Schmitz

(10) Patent No.: US 6,769,355 B1
(45) Date of Patent: Aug. 3, 2004

(54) AUTO-POSITIONING INCHING CONTROL

(75) Inventor: David Schmitz, Coldwater, OH (US)

(73) Assignee: The Minster Machine Company, Minster, OH (US)

( * ) Notice: Subject to any disclaimer, the term of this patent is extended or adjusted under 35 U.S.C. 154(b) by 0 days.

(21) Appl. No.: 09/515,553

(22) Filed: Feb. 29, 2000

(51) Int. Cl.[7] ..... B30B 5/14
(52) U.S. Cl. ..... 100/48; 100/257
(58) Field of Search ..... 100/257, 282, 100/48; 72/417, 444, 21.3; 192/12 C, 18 A, 206; 700/206

(56) References Cited

U.S. PATENT DOCUMENTS 2,755,687 A 7/1956 Danly
3,720,296 A 3/1973 Ohno
3,797,623 A * 3/1974 Gregorovich et al. ..... 192/215
3,859,863 A 1/1975 Howlett
3,888,097 A * 6/1975 Fortman et al. ..... 72/444
3,987,283 A * 10/1976 Moeller ..... 192/127
4,177,517 A * 12/1979 Mette et al. ..... 700/206
4,846,014 A * 7/1989 Shiga et al. ..... 100/257
5,140,834 A 8/1992 Kashiwagi et al.
5,444,613 A * 8/1995 Tani et al. ..... 700/56
5,470,218 A * 11/1995 Hillman et al. ..... 425/150
5,603,237 A 2/1997 Bohman et al.
5,680,915 A * 10/1997 Sommer ..... 192/12 C
5,868,020 A * 2/1999 Delaney et al. ..... 72/21.3

* cited by examiner

*Primary Examiner*—John Sipos
*Assistant Examiner*—Louis Huynh
(74) *Attorney, Agent, or Firm*—Randall J. Knuth

(57) ABSTRACT

An auto-positioning inching control for a mechanical press allows a press operator to select one of a plurality of preset slide stop zones in which the slide may be stopped. A programmable logic controller is utilized to compute values of clutch dropout which will operatively position the slide in one of a plurality of preselected slide stop zones. An additional inching mechanism may be utilized for further movement of the slide within the preselected slide stop zone.

24 Claims, 3 Drawing Sheets

AUTO-POSITIONING INCHING CONTROL

BACKGROUND OF THE INVENTION

1. Field of the Invention

The present invention relates to a mechanical press and more particularly to an auto-positioning inching control device for placing the slide in stop positions at various locations along the slide path.

2. Description of the Related Art

Mechanical presses of the type performing stamping and drawing operations employ a conventional construction which includes a frame structure having a crown and a bed and which supports the slide in a manner enabling reciprocating movement toward and away from the bed. These press machines are widely used for a variety of workpiece operations and employ a large selection of die sets with the press machine varying considerably in size and available tonnage depending upon its intended use.

A flywheel and clutch assembly are utilized to transmit mechanical energy from a main drive motor to the press crankshaft. The flywheel assembly serves as the primary source of stored mechanical energy and rotary driving power. Standard press configurations have the flywheel located between the main drive motor and clutch, with the flywheel being mounted on either the driveshaft, crankshaft or press frame by use of a quill. The main drive motor replenishes the flywheel with rotational energy as it becomes depleted due to press stamping operations during which the clutch engages the flywheel and establishes a driving connection between the flywheel and the crankshaft. When the crankshaft and flywheel are engaged in driving relationship, the flywheel energy is usefully converted into mechanical work to power the press components including the slide. During engagement of the clutch, the flywheel drops in speed as the press driven parts are brought up to running speed.

Setting the slide to a particular stroke position along the slide path is useful during tooling setup as well as stock material feed setup. Positioning the slide along the slide path can be accomplished by manually rotating the flywheel with the clutch engaged or by pulsing the clutch while the flywheel is rotating.

Manually rotating the flywheel may be accomplished by inserting a lever such as a long metal bar into bores within the flywheel. Lifting or pulling down on the bar will then manually rotate the flywheel and cause the slide to move up or down. This method of flywheel adjustment is time consuming and requires that flywheel motion be stopped. Slide positioning utilizing this method is inaccurate as it is based upon visual indication of slide position as perceived by the press operator.

Intermittently engaging or pulsing the clutch is additionally problematic as the frequent engagement and disengagement of the clutch causes excessive wear to the clutch components. Additionally, this method of slide adjustment produces inconsistent slide motion per pulse since the distance the slide moves per pulse is dependent upon, for example, counter balance settings and slide position. Since pulsing a clutch in equal time intervals will not produce equal slide movement, this method of achieving a stop position for the slide of a mechanical press is inaccurate as it is based upon visual indications of slide position as perceived by a press operator and unequal increments of slide movement.

What is needed in the art is a method and apparatus for allowing a press operator to choose preselected slide stop position zones in which the slide of a mechanical press may be stopped. What is further needed in the art is a device for placing the slide of a mechanical press into a preselected stop zone which does not require manual movement of the flywheel of the press, and which does not excessively wear the clutch and brake components of the press.

SUMMARY OF THE INVENTION

The present invention overcomes the disadvantages of the currently available methods and apparatus for placing the slide of a mechanical press in a particular stop zone along the slide path.

Generally, the present invention provides a mechanical press operator with a graphical user interface which can be utilized to select a preselected slide stop zone for the mechanical press slide. After selection of the slide stop zone, a computational device is utilized to compute the appropriate clutch dropout based upon press operational parameters such as slide speed, counter balance settings, slide position, and die characteristics. The computational device further monitors the computation time and adjusts clutch dropout accordingly. Since computation time is accounted for, processor speed does not affect the accuracy of the current invention.

The invention, in one form thereof, comprises a slide stop positioning device for positioning the slide of a mechanical press. The slide stop positioning device of this form of the current invention includes a slide actuator for moving the slide along the slide path and a selector which is operable to allow a press operator to select from a plurality of preselected slide stop zones. The selector is operatively connected to the slide actuator so that selection of one of the plurality of preselected slide stop zones will cause the slide actuator to position the slide accordingly. In one form of the current invention, the selector comprises a graphical user interface.

In one form of the current invention, the slide actuator includes a flywheel, a clutch and a crankshaft. The flywheel is rotatably supported by the press and is operable to receive and store rotational energy from a press drive motor. The clutch is operatively positioned for engagement with the flywheel and the crankshaft is operatively connected to the clutch and the slide so that rotational energy of the flywheel may be transmitted by the clutch and the crankshaft into reciprocating movement of the slide. The crankshaft has a top dead center position which corresponds to the rotational position of the crankshaft when the slide is furthest from the bed.

In one form of the current invention, the plurality of preselected slide stop zones comprise zones in 45 degree increments from the top dead center position. The graphical user interface may be, for example, a touch screen on which the plurality of slide stop zones may be arranged in circular form. Alternately, the user may predefine selected start/stop zones.

In one form of the current invention, a computational device is operative to compute a plurality of computed values including the necessary clutch dropout values for each of the plurality of preselected slide stop zones. The computational device may be, for example, a programmable logic controller or a microprocessor. Input means are communicatively connected to the computational device and are operable to communicate a plurality of input values to the computational device. The plurality of input values include a value of machine type, a value of counter balance settings, a value of slide position, a value of slide speed as well as values of die characteristics.

In one form of the current invention, the input means include a manually actuatable input device, a speed sensor, a slide position sensor and a counter balance position sensor. The manually actuatable input device is operative to input any of the plurality of input values. The speed sensor as well as the slide position and counter balance position sensors may be transducers of the type commonly utilized to monitor speed and position parameters. Additionally, RF tag or bar code readers may be utilized if RF or bar tag identifiers are utilized to store any of the plurality of input values. For example, RF tags or other communication devices, such as bar codes may be utilized to store information relating to die characteristics. Such communication of die characteristics is taught by pending U.S. patent application Ser. No. 09/062,210, the disclosure of which is herein explicitly incorporated by reference.

In one form of the current invention, the plurality of computed values computed by the computational device includes a value of computational device computation time for each computed clutch dropout value for each of the plurality of zones. A slide inching mechanism may be provided for use with the slide stop positioning device of the current invention. Such a slide inching mechanism will be operable to further adjust the slide position within any of the plurality of preselected slide stop zones. Such a slide inching mechanism is disclosed in U.S. Pat. No. 5,630,237, the disclosure of which is herein explicitly incorporated by reference.

The invention, in another form thereof, comprises a method of selecting a stop position for the slide of a mechanical press. The method of this form of the current invention includes the steps of: selecting one of a plurality of preselected slide stop zones, computing clutch dropout to achieve the selected preset stop zone for the slide, and disengaging the clutch as indicated by the computed clutch dropout.

In one form of the current invention, the step of selecting a stop zone for the slide further includes the steps of:

providing a graphical user interface including said plurality of preselected slide stop zones and selecting one of said plurality of preselected stop zones for the slide.

In one form of the current invention, the step of computing clutch dropout to achieve the selected preset stop zone for the slide further includes the steps of: providing a computational device, communicating a plurality of input values to said computational device, and computing clutch dropout using said computational device and said plurality of input values. Additionally, the step of providing a graphical user interface having a plurality of slide stop zones may comprise the step of: providing a touch screen having a plurality of selectable slide stop zones.

In one form of the current invention, the step of communicating a plurality of input values to the computational device further includes the steps of: communicating a value of machine type to said computational device, communicating a value of counter balance settings to said computational device, communicating a value of slide position to said computational device, communicating a value of slide speed to said computational device, and communicating values of die characteristics to said computational device.

In one form of the current invention, the method of selecting a stop position for the slide of a mechanical press further includes the step of: providing a slide inching mechanism for further adjusting slide position after the slide comes to rest in a preselected slide stop zone. In yet another form of the current invention, the method of selecting the stop position for the slide of a mechanical press further includes the steps of: monitoring computation time for said computational device and adjusting the value of clutch dropout to account for the monitored computation time.

An advantage of the present invention is the ability to stop the slide of a mechanical press in multiple positions along the slide path without manually rotating the flywheel.

Another advantage of the present invention is the ability to position the slide of a mechanical press at various stop positions along the slide path without causing excessive wear to the clutch and brake components of the press.

A further advantage of the present invention is the ability to position the slide of a mechanical press at differing stop positions along the slide path without relying upon the perception of the press operator to position the slide at a particular location.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
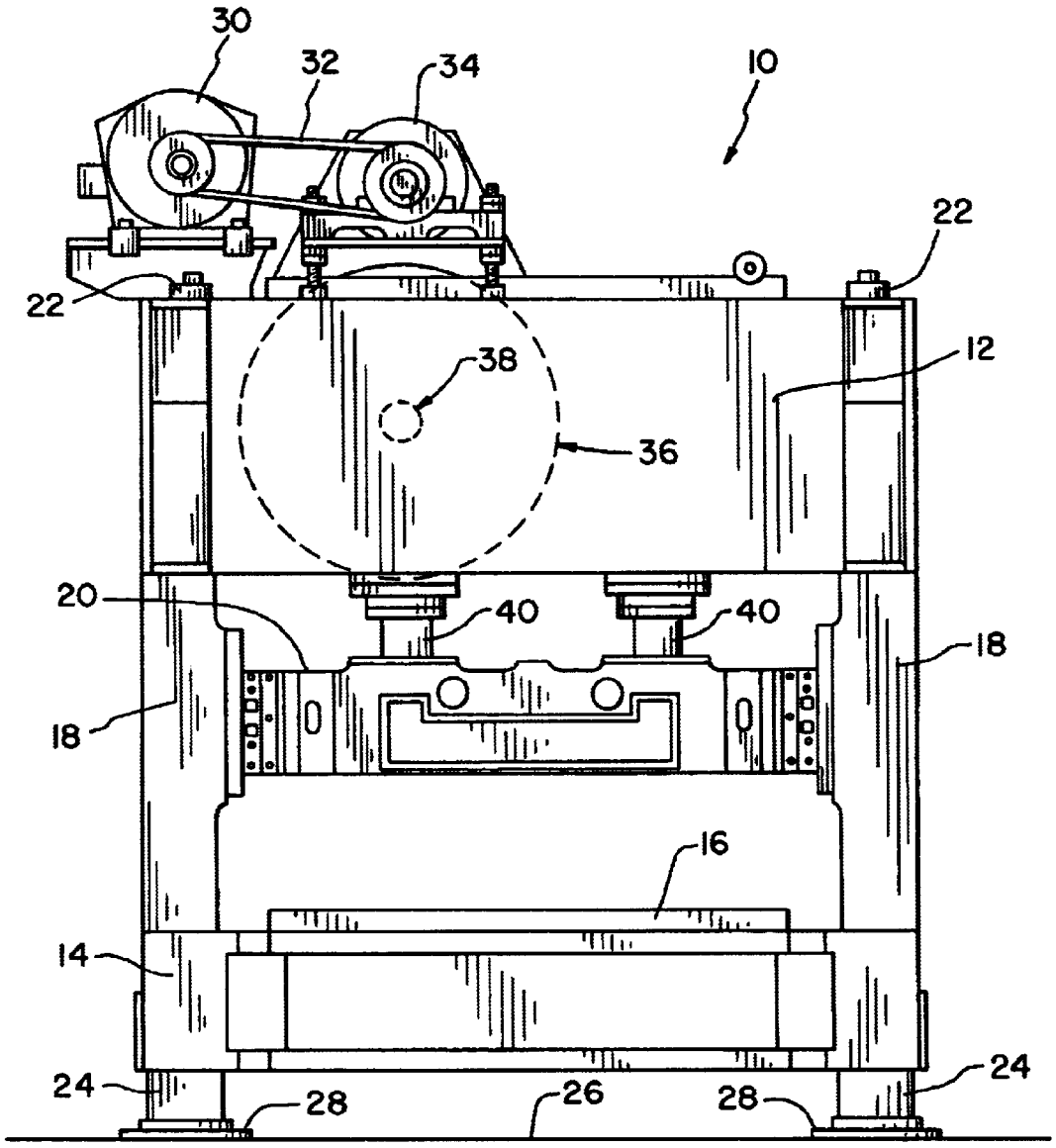
FIG. 1 is a front elevational view of a mechanical press incorporating one form of the present invention.

Referring now to the drawings and particularly to FIG. 1, mechanical press 10 comprises crown 12, bed 14 having a bolster assembly 16 connected thereto with uprights 18 connecting crown 12 with bed 14. Uprights 18 are connected or integral with the underside of crown 12 and the upper side of bed 14. A slide 20 is positioned between uprights 18 for reciprocating movement. Tie rods (not shown) extending through crown 12, uprights 18, and bed 14 are attached at each end with tie rod nuts 22. Leg members 24 are formed as an extension of bed 14 and are generally mounted on shop floor 26 by means of shock absorbing pads 28. A press drive motor 30 is attached by means of belt 32 to auxiliary flywheel 34. Auxiliary flywheel 34 is connected by means of a belt (not shown) to the main flywheel depicted generally at 36. The flywheel/clutch/brake assembly is depicted generally at 36 with the main flywheel being operative to transmit rotational motion to crankshaft 38. Crankshaft 38 is connected to slide 20 by way of connecting rods 40. Crankshaft 38 is operatively connected to connecting rods 40 so that the rotary motion of crankshaft 38 is translated into reciprocating movement of slide 20.

Generally, the present invention utilizes a computational device to compute and control the dropout position necessary to achieve a plurality of preselected slide stop zones.

Slide motion is initiated by the press operator and a computational device, such as a programmable logic controller receives a plurality of inputs relating to press operational state, including slide speed and position. The computational device then utilizes the input information to compute the appropriate dropout position of the clutch to achieve the selected slide stop zone.

In one embodiment of the invention, dropout positions are determined from a first value and a second value that are input into the programmable logic controller during the initial setup of the mechanical press 10. Because the first value and second value remain substantially constant during the life of the mechanical press 10, these numbers will only need to be received once, and the dropout positions can be calculated therefrom knowing the press speed.

The first value represents the reaction time of the flywheel/clutch/brake assembly 36. According to the invention, the first value is the composite time that it takes for a relay to remove electrical power from a clutch valve (not shown), the time it takes the clutch valve to respond to that signal, and the time it takes for the flywheel/clutch/brake assembly 36 to move an actuating device from a clutch position to a brake position.

The second value represents the amount of advancement necessary per each unit of strokes per minute of the press speed. This value can be determined by repeatedly running the press at top speed, signaling to stop the press, and adjusting the second value, until the press stops at the desired position. Once this value is determined, it is consistent throughout press operation for any press speed.

Once the first and second values are known, the programmable logic controller need only receive the value of press speed from speed sensor 52, and employ the three values in the computation for determining the dropout position of the clutch valve.

Figure 2:
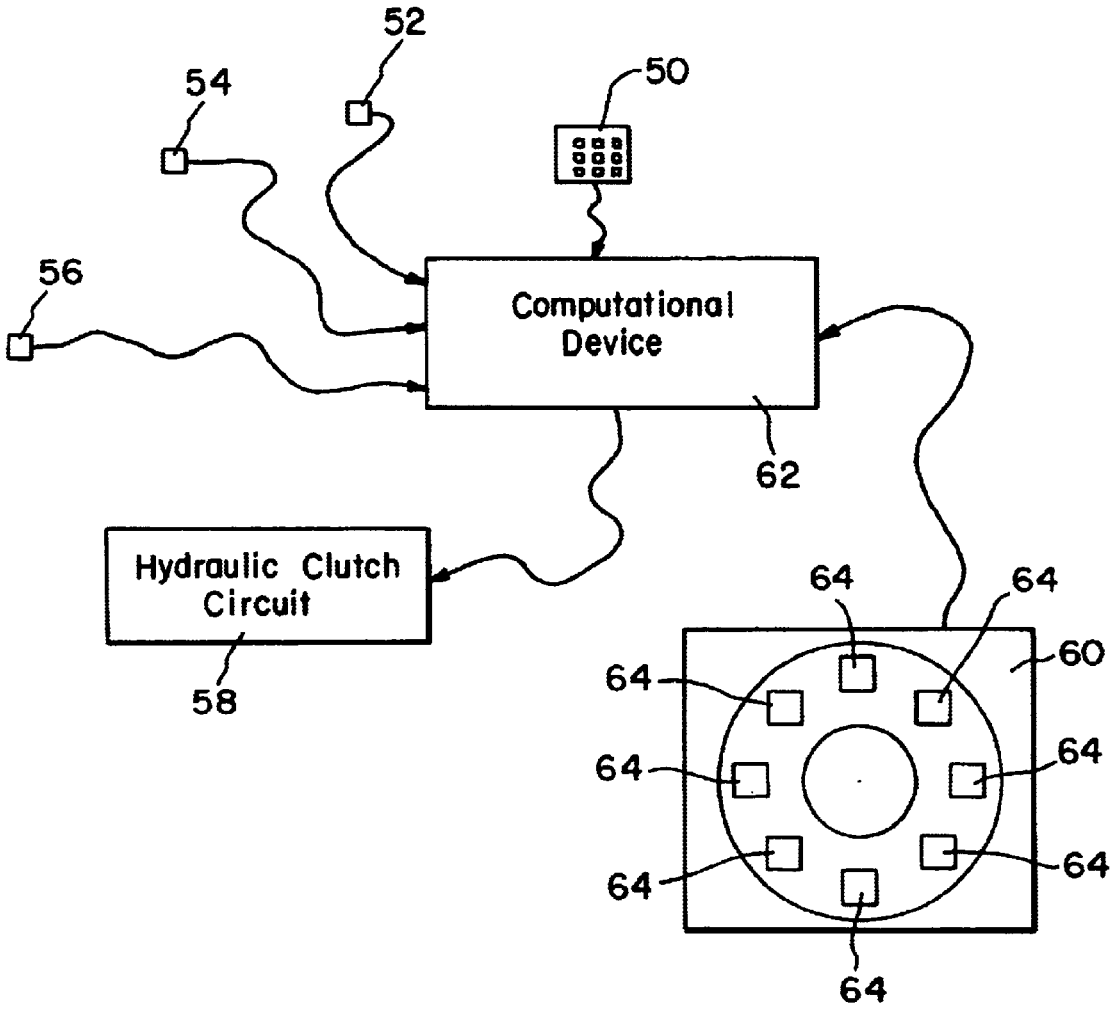
FIG. 2 is a schematic representation of an embodiment of the current invention.

FIG. 2 illustrates one embodiment of the invention wherein computational device 62 receives sensed slide position values from slide position sensor 54 and counter balance position values from counter balance position sensor 56. Slide and counter balance position sensors 54 and 56 can be non-contact displacement sensors, such as hall-effect sensors. Computational device 62 further receives a value of press speed from speed sensor 52. Computational device 62 is communicatively connected to graphical user interface 60 and clutch circuit 58. Computational device 62 receives input from input device 50, speed sensor 52, slide position sensor 54 and counter balance position sensor 56 and utilizes this information to generate clutch dropout values for a plurality of preselected slide stop zones.

The following algorithm is used to compute the clutch dropout value for a selected slide stop zone given the speed value, the first and second values as discussed above, and a value representing the scan time of the programmable logic controller. First, the speed value from speed sensor 52 is converted into appropriate units and multiplied by the first value, and then added to the second value. This gives the total stop time. Next, this total stop time is converted into degrees by multiplying 360 by the sum of the stop time and the programmable logic controller scan time value, and dividing the entire product by 60/press speed.

Once the dropout value is determined in degrees, it is subtracted from the desired slide stop zone, resulting in the dropout position of the clutch valves.

Figure 3:
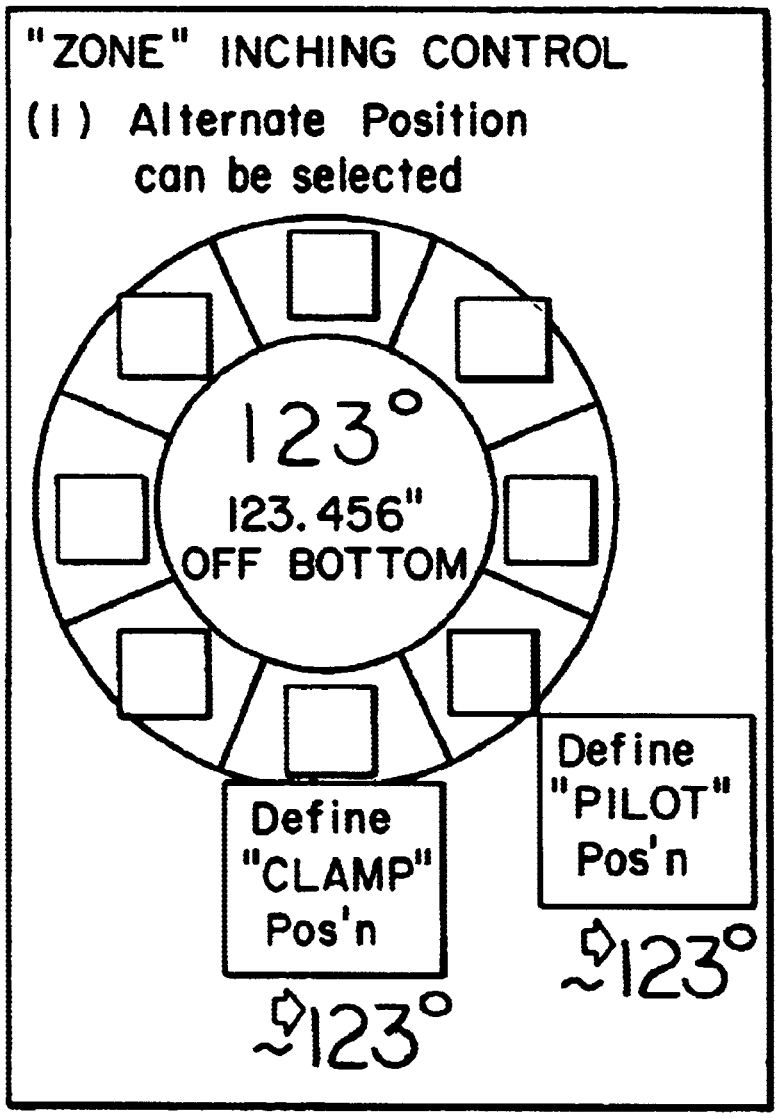
FIG. 3 is a schematic representation of another embodiment of the current invention.

Graphical user interface 60 includes preselected slide stop zones 64 in 45 degree increments from top dead center. Graphical user interface 60 can be, for example, any of the well known touch screens currently used in the art. Alternately, as shown in FIG. 3, slide stop zones may be located via a setup routine utilizing an ability for the operation to set a clamp position and pilot position as opposed to zone (45°) control. This enhancement allows the operator to define the exact "pilot" and "clamp" position by inching the press into these positions, and depressing the appropriate cell on the screen. These two positions are retained in tool storage for this particular die.

In operation, the clutch engages the main flywheel of the press to transmit the rotary motion of the flywheel to crankshaft 38 which rotary motion is then translated into reciprocating motion of slide 20. During tooling or feed roll setup, it is often desirable to place slide 20 in varying stop positions along the slide path. Graphical user interface 60 may be utilized by the press operator to select one of a plurality of preselected slide stop zones. Computational device 62 then utilizes press speed as well as the input and monitored characteristics of the press to compute the appropriate clutch dropout or disengagement necessary to achieve the selected slide stop position. Computational device 62 is further operative to monitor the computation time and to adjust the clutch dropout accordingly so that the slide stop position is more accurately computed. Computational device 62 is operatively connected to clutch circuit 58 and is operative to signal clutch circuit 58 to dropout the clutch to achieve the desired preselected slide stop zone.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A slide stop positioning device for positioning a slide of a mechanical press, comprising:

a slide actuation system, said slide actuation system being configured for selectably moving said slide; and a selector means for defining a plurality of predetermined slide stop zones and for facilitating a stopped positioning of said slide based on a selected slide stop zone, said selector means being operatively associated with said slide actuation system and operable to allow a press operator to select any one of said plurality of predetermined slide stop zones to thereby be the selected slide stop zone representing a chosen zonal resting location for said slide.

2. The slide stop positioning device as recited in claim 1, wherein said selector means comprises a graphical user interface.

3. The slide stop positioning device as recited in claim 2, wherein said slide actuating system comprises:

a flywheel, said flywheel rotatively supported by the press;

a clutch, said clutch operatively positioned for engagement with said flywheel; and a crankshaft, said crankshaft operatively connected to said clutch, said crankshaft operatively connected to the slide, said crankshaft having a top dead center position.

4. The slide stop positioning device as recited in claim 3, wherein said plurality of preselected slide stop zone comprise zones in 45 degree increments from said top dead center position.

5. The slide stop positioning device as recited in claim 4, wherein said graphical user interface comprises a touch screen.

6. The slide stop positioning device as recited in claim 5, wherein said plurality of slide stop zones are arranged in circular form on said graphical interface.

7. The slide stop positioning device as recited in claim 1, further comprising:

a computational device electronically connected to said selector means, said computational device being operative to compute a plurality of computed values.

8. The slide stop positioning device as recited in claim 7, wherein said computational device comprises:

a programmable logic controller.

9. The slide stop positioning device as recited in claim 7, wherein said computational device comprises:

a microprocessor.

10. The slide stop positioning device as recited in claim 7, further comprising:

input means, said input means communicatively connected to said computational device, said input means being operable to communicate a plurality of input values to said computational device.

11. The slide stop positioning device as recited in claim 10, wherein said plurality of input values comprises:

a value of machine type;

a value of counter balance settings;

a value of slide position;

a value of slide speed; and values of die characteristics.

12. The slide stop positioning device as recited in claim 11, wherein said input means comprises:

a manually actuatable input device, wherein said manually actuatable input device is operative to input any of said plurality of input values;

a speed sensor for sensing a value of press speed;

a slide position sensor; and a counter balance position sensor.

13. The slide stop positioning device as recited in claim 7, wherein said plurality of computed values comprise clutch dropout values for each of said plurality of preselected slide stop zones.

14. The slide stop positioning device as recited in claim 13, wherein said plurality of computed values further comprises a value of computational device computation time for each computed clutch dropout value for each of said plurality of zones.

15. The slide stop positioning device as recited in claim 13, further comprising:

a slide inching mechanism, said slide inching mechanism being operable to further adjust the slide position within any of said plurality of preselected slide stop zones.

16. A system in association with a press machine having a slide, said system comprising:

a slide movement assembly configured to selectably moving said slide; and a selector means for defining a plurality of predetermined slide stop zones and for facilitating a stopped positioning of said slide based on a selected slide stop zone, said selector means being operatively associated with said slide movement assembly and operable to allow a user to select any one of said plurality of predetermined slide stop zones to thereby be the selected slide stop zone representing a chosen zonal resting location for said slide.

17. The system as recited in claim 16, further comprising:

a processor, said processor being configured to control operation of said slide movement assembly, using the selected slide stop zone.

18. The system as recited in claim 17, wherein said slide movement assembly further comprises:

a clutch control circuit.

19. The system as recited in claim 17, wherein said processor being configured further to generate at least one apparatus control signal as a function of press machine type, counter balance setting and/or position, slide position, slide speed, die characteristics, or any combination thereof.

20. The system as recited in claim 19, wherein the at least one apparatus control signal includes a signal specifying clutch dropout.

21. The system as recited in claim 16, wherein said slide movement assembly further includes a brake-clutch combination.

22. A system in association with a press machine having a slide, said system comprising:

a slide movement assembly configured to selectably moving said slide; and a selector means for defining a plurality of distinct selectable slide stop zones and for facilitating a stopped positioning of said slide based on a selected slide stop zone, said selector means being operatively associated with said slide movement assembly, any one of said distinct selectable slide stop zones being capable of being chosen as the selected slide stop zone, the selected slide stop zone representing a chosen zonal resting location for said slide; and a unit configured to control operation of said movement assembly, using the selected slide stop zone operatively received from said selector means.

23. The system as recited in claim 22, wherein said unit being configured further to generate at least one assembly control signal as a function of press machine type, counter balance setting and/or position, slide position, slide speed die characteristics, or any combination thereof.

24. The system as recited in claim 23, wherein the at least one assembly control signal includes a signal specifying clutch dropout.

* * * * *